United States Patent [19]

Hefftler et al.

[11] Patent Number: 4,867,060

[45] Date of Patent: Sep. 19, 1989

[54] DRIVE SYSTEM FOR SHEET-FED ROTARY PRINTING MACHINE

[76] Inventors: Victor Hefftler, Hermann-Matern-Str. 1b, 8270 Coswig; Hans Johne, Geschwister-Scholl-Str. 9, 8122 Radebeul; Horst Schulz, Wilder-Mann-Str. 25c, 8023 Dresden; Arndt Jentzsch, Friedewaldstr. 3a, 8270 Coswig; Helmut Schöne, Geschwister-Scholl-Str. 9, 8122 Radebeul, all of German Democratic Rep.

[21] Appl. No.: 947,024

[22] Filed: Dec. 29, 1986

[30] Foreign Application Priority Data

Dec. 27, 1985 [DD] German Democratic Rep. ... 285547

[51] Int. Cl.[4] ..... B41F 5/02; B41F 7/12

[52] U.S. Cl. ..... 101/183

[58] Field of Search ..... 101/183, 184, 180, 181, 101/DIG. 11

[56] References Cited

U.S. PATENT DOCUMENTS

| | | | |
|---|---|---|---|
| 2,707,914 | 5/1955 | Harrold | 101/183 |
| 4,183,296 | 1/1980 | Rambausek | 101/183 X |

FOREIGN PATENT DOCUMENTS

| | | | |
|---|---|---|---|
| 2334177 | 1/1975 | Fed. Rep. of Germany . | |
| 2758900 | 10/1978 | Fed. Rep. of Germany | 101/183 |
| 737245 | 5/1980 | U.S.S.R. | 101/183 |
| 1183467 | 3/1970 | United Kingdom | 101/183 |

*Primary Examiner*—Clifford D. Crowder

[57] ABSTRACT

To guarantee an exact engagement of toothed flanks in the driving gear train of a multi-color sheet-fed rotary printing machine, the gears in the train pertaining to the first printing unit of the machine are power supplied from a driving member which transmits a two-fold power portion in comparison to power portions transmitted by driving elements assigned to the remaining printing units.

4 Claims, 1 Drawing Sheet

DRIVE SYSTEM FOR SHEET-FED ROTARY PRINTING MACHINE

BACKGROUND OF THE INVENTION

The present invention relates to a sheet-fed rotary printing machine provided with a driving system.

From prior art, for example from the German Pat. No. 2,334,177, sheet-fed rotary printing machines are known which include a sheet feeder, a series of printing units wherein the first printing unit cooperates with the feeder and the last printing unit cooperates with a discharger for printed sheets, a gear train for interconnecting impression cylinders and transfer cylinders of respective printing units, and a driving system provided with at least one driving element for transmitting parts of driving power to the gear train.

In modern printing industry employing sheet-fed rotary printing machines, there has been trend towards more and more structural alterations of the machines in order to rationalize and increase quality of the processed order. Continuously increasing demand is for printed products of highest quality having brilliant colors whereby in one running through the machine there is produced four color first printing on the front side and two colors printing on the backside followed with surface finish by varnishing and drying the varnish and the paint coat, e.g. Due to the consistent paints and viscous varnishes employed for this purpose power input in the machine is simultaneously increased and so are the static as well as dynamic forces acting on the machine. As a result of the higher loads of such multicolor printing machines there is a tendency to interfering low frequency vibrations which impair particularly the quality of the sheet transfer from one printing unit to another because the engagement of the toothed flanks in the gear train of the impression cylinders and transfer cylinders is disturbed.

Therefore, it is disadvantageous that in prior art driving systems for the heavily loaded printing machines, a continuous contact or engagement between the flanks is no longer guaranteed under the beforedescribed conditions. To avoid this drawback in series connected drives an overdimensioning of the driving gears would be necessary which would result in steep increase of construction costs. In addition, in printing machines having a plurality of printing units, such as for example a ten color printing machine, it is also disadvantageous that with increasing printing power the intake printing unit and the discharging printing unit run out of register.

SUMMARY OF THE INVENTION

It is, therefore, a general object of this invention to increase the quality of printed products even under the condition of continuous requirements for an increased productivity.

In particular, it is an object of this invention to provide a sheet-fed rotary printing machine having a driving system which even under a high printing output and under difficult operational conditions guarantees an almost constant power flow in all printing units inclusive of the discharging printing unit.

Still another object of this invention is to insure an exact engagement of teeth flanks in the driving gear train.

In keeping with these objects and others which will become apparent hereafter, one feature of this invention resides in the provision of means for transmitting to a driving unit pertaining to the first printing unit a doubled part of driving power than that transmitted to respective driving units pertaining to the remaining printing units.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
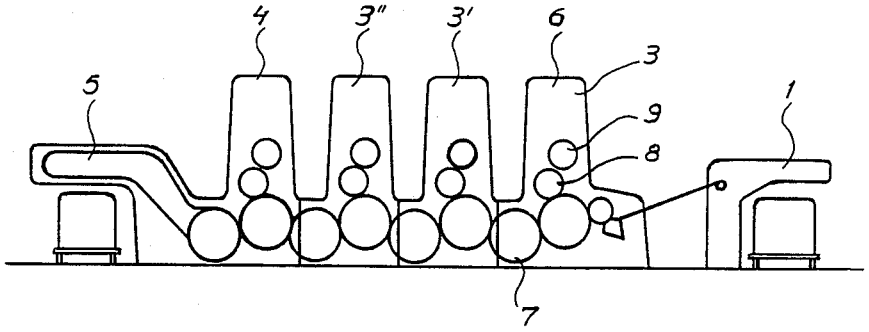
FIG. 1 shows schematically a sheet-fed four color printing machine.

FIG. 1 illustrates schematically a sheet-fed rotary printing machine of an aggregated construction modified for printing in four colors. The machine includes a feeder 1 for sheets to be printed. A series of three printing units 3, 3' and 3'' and a final or discharging printing unit 4 cooperating with a discharger 5 for printed sheets. Each of the printing units includes an impression cylinder 6, a transfer cylinder 7, a blanket or offset cylinder 8 and a plate cylinder 9.

The impression cylinder 6 and the transfer cylinder 7 of respective printing units 3, 3', 3'' and 4 are interconnected by a gear train 10 which is a component part of a drive system of the printing machine. The gear train is formed by meshing gears 11 and 12 arranged on respective impression and transfer cylinders. The first printing unit 3 of the machine is provided with a driving member 13 which transmits to the first printing unit a doubled part of driving power as compared with the parts of driving power transferred to the remaining printing units. Both the second and the third printing unit 3' and 3'' in the series is provided with a driving member 14 which transmits to the assigned printing unit a substantially uniform quota of driving power corresponding to half of the driving power of the member 13.

For a certain printing output the total (100%) driving power supplied to the printing machine is divided by the number of printing units inclusive of the discharging printing unit.

For a four color printing machine, the doubled portion of the driving power for the first printing unit is computed as follows:

$$\frac{100\%\ \text{(total driving power)} \times 2}{4\ \text{(printing units of the color printing machine)}} = 50\%$$

The uniform power quotas transmitted by driving units assigned to the remaining printing units preceding the last printing unit is computed as follow:

$$\frac{100\% \text{ (total power)} \times 1}{4 \text{ (units of the machine)}} = 25\%$$

Figure 2:
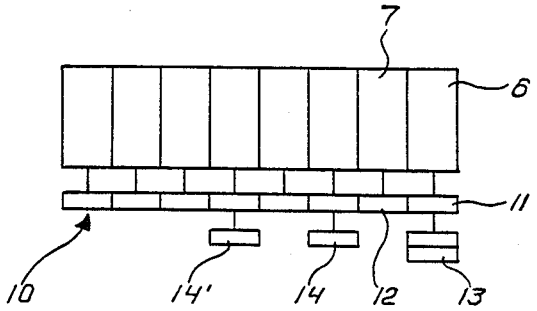
FIG. 2 is a schematic top view of an embodiment of the driving system of the printing machine of FIG. 1, employing a motor drive.

The double-power unit 13 and the remaining simple power driving units 14 and 14' in the embodiment illustrated in FIG. 2 are in the form of separate drives, such as electrical motors or hydraulic motors. In this embodiment, the differentiated power distribution is achieved by a two-fold torque of the first driving unit 13 in comparison with the lower torque of the remaining driving units 14 and 14' provided that the gears in the gear train have the same rotary speed.

Figure 3:
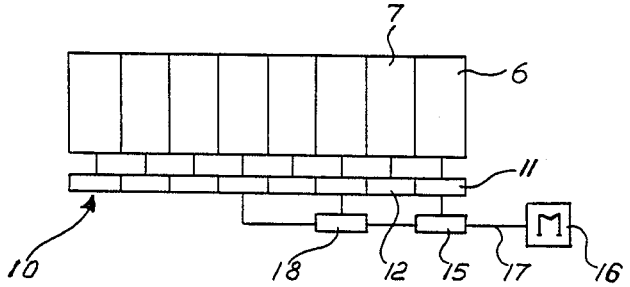
FIG. 3 is a schematic top view of another embodiment of the driving system of the machine of FIG. 1, using a differential drive.

In the embodiment of FIG. 3, there are employed conventional differential gears 15 and 18 to serve as the driving units for the gear train 10. This embodiment is applicable in a three color printing machine using three printing units. In a modification for a four color printing machine, the driving system includes a single electric motor 16 for transmitting the total power via a longitudinal shaft 17 to differential gears 15 and 18. The terminal differential gear 18 drives the printing units 3' and 3'' whereby the last printing unit 4 is power driven by the preceding printing unit 3''. Accordingly, in the case of a five color printing machine the final differential gear 18 drives the last three printing units as in the preceding example whereas the first two printing units are driven by two differential gears 15. The power distribution according to this invention is achieved in conventional manner by such a design of the differential gears 15 and 18 that at a constant rotary speed of shaft 17 the gear 15 supplies twice as large torque as that supplied by the gear 18.

A survey of the two-fold driving power for the first printing unit, the uniform lower driving power for the subsequent printing units and the corresponding driving members or units are shown in the following table:

| Printing Machine Modification | Two-fold power for the first printing unit | One-fold driving power for each of the subsequent printing units | No. of Driving Units: Motors | No. of Driving Units: Differential Gears | |
|---|---|---|---|---|---|
| 2-color printing machine | $\frac{100\% \times 2}{2} = 100\%$ | — | 1 | — | |
| 3-color printing machine | $\frac{100\% \times 2}{3} = 66.6\%$ | $1 \times \frac{100\% \times 1}{3} = 33.3\%$ | 2 | 1 | end differential |
| 4-color printing machine | $\frac{100\% \times 2}{4} = 50\%$ | $2 \times \frac{100\% \times 1}{4} = 25\%$ | 3 | 1 | end differential |
| | | | | 1 | differential |
| 5-color printing machine | $\frac{100\% \times 2}{5} = 40\%$ | $3 \times \frac{100\% \times 1}{5} = 20\%$ | 4 | 2 | differentials |
| | | | | 1 | end differential |

The sheet feeder, the last printing unit and the printed sheet discharger by themselves are not driven by any additional driving unit but are driven by the gear train 10 only.

The illustrated embodiments of the driving system are applicable also for the two-color printing machines nevertheless the full effect of this invention becomes apparent only in the machine modifications for the three or four color printing.

Figure 4:
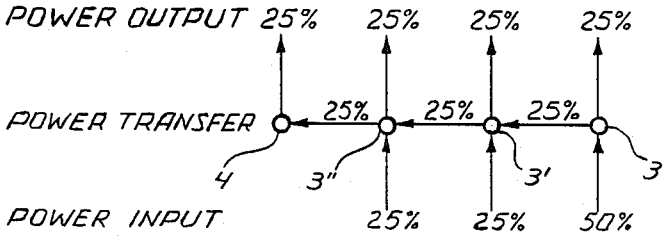
FIG. 4 is a diagram illustrating the power flow in the driving system of the machine of FIG. 1.

The operation of the sheet-fed rotary printing machine of this invention will be explained with reference to the flow diagram of FIG. 4.

Total input power (100%) supplied by driving members 13 and 14 to a four-color printing machine is distributed such that gear 11 of the first printing unit 3 receives 50% of the total power whereas the corresponding gears of the remaining printing units 3' and 3'' receive 25% of the total power each, as indicated by lower vertical arrows. In other words, the gear 11 of the first printing unit 3 is designed for taking over twice as much of the load as corresponding gears of each of the subsequent printing units. Consequently, as indicated by horizontally directed arrows the gear train transfers the full power of the driving system to respective printing units in such a manner that under any operational condition of the machine, an exact and full engagement of the toothed flanks of the tranmission gear train is guaranteed. At the same time, each of the printing units inclusive the last printing unit, operates at its full capacity with uniformly distributed power outputs, as indicated by upper vertical arrows.

What is claimed as new and desired to be protected by Letters Patent is set forth in the appended claims:

1. A sheet-fed rotary printing machine including a feeder for sheets to be printed, as series of at least four printing units wherein the first printing unit cooperates with said feeder and the last printing unit cooperates with a discharger for printed sheets, a gear train for interconnecting impression cylinders and transfer cylinders of respective printing units, and a driving system provided with a plurality of driving members for transmitting driving power to said gear train, comprising a first driving member designed for transmitting to gears connected to cylinders of said first printing unit a part of total driving power which is a double of respective power parts transmitted to corresponding gears by the remaining driving members; and the number of said driving members corresponding to the number of said printing units less one.

2. A rotary printing machine as defined in claim 1, wherein said remaining driving members drive printing units between said first and last printing units in series.

3. A rotary printing machine as defined in claim 1, wherein said driving members are separate motors.

4. A rotary printing machine as defined in claim 1, wherein said driving system includes a driving motor for delivering a total driving power, said driving members being in the form of differential gears driven by said driving motor via a longitudinal shaft.

* * * * *